US006040540A

United States Patent [19]

Tsai et al.

[11] Patent Number: 6,040,540

[45] Date of Patent: Mar. 21, 2000

[54] KEYSWITCH STRUCTURE

[75] Inventors: Ching Cheng Tsai, Keelung; Wen To Chou, Taipei Hsien, both of Taiwan

[73] Assignee: Chicony Electronics Co., Ltd., Taipei Hsien, Taiwan

[21] Appl. No.: 09/229,557

[22] Filed: Jan. 13, 1999

[51] Int. Cl.[7] ..... H01H 13/70

[52] U.S. Cl. ..... 200/344; 200/341

[58] Field of Search ..... 200/341, 344, 200/345

[56] References Cited

U.S. PATENT DOCUMENTS 5,829,579 11/1998 Tsai ..... 200/344

5,850,194 12/1998 Lin ..... 341/22

5,878,872 3/1999 Tsai ..... 200/344

*Primary Examiner*—Michael L. Gellner

*Assistant Examiner*—Nhung Nguyen

*Attorney, Agent, or Firm*—Rosenberg, Klein & Lee

[57] ABSTRACT

The inventive keyswitch comprises a base plate, a conductive membrane, an elastic member, a key support mechanism and a key wherein the first support lever and the second lever of the key support mechanism are of the same structure and pivotably joined in a scissors-form. The molding die can be simplified, the assembling efficiency can be enhanced and the cost is reduced.

8 Claims, 5 Drawing Sheets

KEYSWITCH STRUCTURE

FIELD OF THE INVENTION

The present relates to an improved keyswitch, more particularly, to an improved keyswitch the key support mechanism thereof comprising two pivotally-joined and identical support levers, whereby the cost is reduced for using only one set of molding die for the support lever.

BACKGROUND OF THE INVENTION

As shown in FIG. 4, the conventional keyswitch 20 generally comprises a base plate 71, a printed circuit board 72, an insulating membrane 73, an elastic member 74, a key support mechanism 75 and key 76. The key support mechanism is formed by pivotally joining a first support lever 751 and a second support lever 752 in a scissors-form. However, as also shown in this figure, the shape and the structure of these two support levers are different, wherein the first support lever 751 is of □ shape and the second support lever 752 is of U shape, and the first support lever 751 is arranged between two arms of the second support lever 752. Therefore, two set of different molding dies are required to designed these two support levers. The cost is hard to reduce. Moreover, the orientation and order of the support levers 751 and 752 should be careful during assembling. For example, the support levers 751 and 752 may be assembled with the same or the opposite orientation. The assembling efficiency is therefore degraded.

Moreover, the conventional keyswitch generally has a stop pole formed by pressing at the pivoting groove 711 of the base plate 71 when the support levers 751 and 752 are pivotally connected to the base plate 71. The stop pole 712 is used to restrain the bump 753 of the support lever 751. However, the stop pole 712 is only provided at the center (as shown in FIG. 4) of the base plate 71, the support lever is wont to shake laterally and hard to be stably fixed on the base plate 71. Moreover, through hole must be formed between the stop pole 712 and the base plate 71, the openings 721 and 731 on the stop pole 712 and the base plate 71 is forced to be enlarged.

Moreover, as shown in FIG. 5, the key 76 is conventional keyswitch has pivoting recess 761 and sliding groove 762 for the pivotal engaging of the pivot shaft 754 and 755 of the support levers 751 and 752, respectively. The pivoting recess 761 is generally formed by two retaining arms 763 and 764, as shown in FIG. 4, which is separated by a predetermined distance to clamp the pivot shaft 754 of the support lever 752. However, the pivot shaft 754 is wont to release because the retaining arms 763 and 764 only clamp one forth length of the pivot shaft. The two retaining arms 763 and 764 are wont to break because they have the same thickness.

It is the object of the invention to provide an improved keyswitch to overcome above problems.

In one aspect of the invention, the inventive keyswitch comprises a base plate, a conductive membrane, an elastic member, a key support mechanism and a key wherein the first support lever and the second lever of the key support mechanism are of the same structure and pivotably joined in a scissors-form. The molding die can be simplified, the assembling efficiency can be enhanced and the cost is reduced.

In another aspect of the invention, the inventive keyswitch has pivoting recess formed by two retaining walls separated by such distance that the pivot shaft of the support lever is just fitted therebetween. A hook is formed on the free end of one of the retaining walls and has length exceeding the half length of the pivot shaft. The other one of the retaining walls has thinner thickness such that it has flexibility to shift outward to prevent the break thereof.

In still other aspect of the invention, two stop poles separated by a predetermined distance are formed on one side of the pivot recess on the base plate to prevent the release of the pivot shaft retained within the pivot recess. The stop poles has chamfered edge to facilitate the insertion of the pivot shaft and has augmented number to more firmly retain the pivot shaft of the support lever and prevent the lateral movement of the pivot shaft.

The various objects and advantages of the present invention will be more readily understood from the following detailed description when read in conjunction with the appended drawing, in which:

DETAIL DESCRIPTION OF PREFERRED EMBODIMENT

Figure 1:
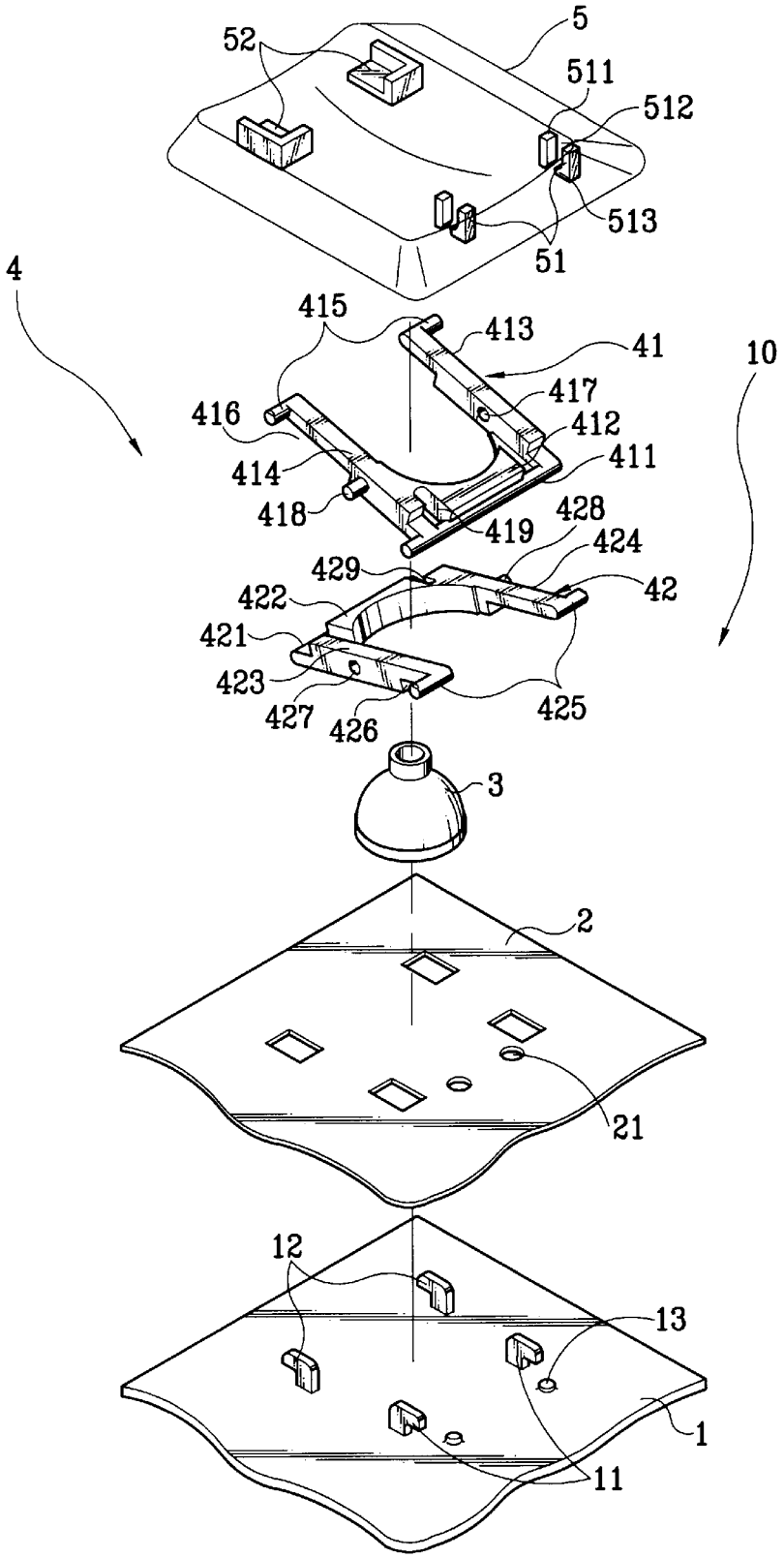
FIG. 1 shows the exploded view of the inventive keyswitch.

As shown in FIG. 1, the inventive keyswitch 10 comprises a base plate 1, a conductive membrane 2, an elastic member 3, a key support mechanism 4 and a key 5. The detailed description of the conductive membrane 2, the elastic member 3, the support mechanism 4 and the key 5 are omitted here because they are not features of the present invention. The support mechanism 4 is formed by pivotally joining a first support lever 41 and a second support lever 42 in a scissors-form. The first and second support levers 41 and 42 have the same structure, therefore only the structure of the first support lever 41 is explained below. The first support lever 41 comprises a first lateral shaft 411 used to pivotally engage within the recess 11 of the base plate 1, a semi-circle shape rib 412 formed on the inner portion of the first lateral shaft 411 to enhance the structural strength there. The two ribs 412 and 422 are both of semi-circle shape and together form a circular groove 43 for clamping the elastic member 3 such that the support levers 41 and 42 are assembled together. An opening groove 419 is arranged on each of two lateral sides of the rib 412.

Moreover, first vertical shaft 413 and second vertical shaft 414 are provided on both sides of the first lateral shaft 411, and first pivot shaft 415 extends from the free end of the first vertical shaft 413 and second vertical shaft 414. The pivot shaft 415 is pivotally engaged into the pivot groove 52 of the key 5 and is not on same altitude with the first lateral shaft 411. Moreover, a dent 416 is formed near the first pivot shaft 415, a through hole 417 is formed on the center position of the first vertical shaft 413, a projecting bar 418 is formed on the corresponding location of second vertical shaft 414.

Figure 2:
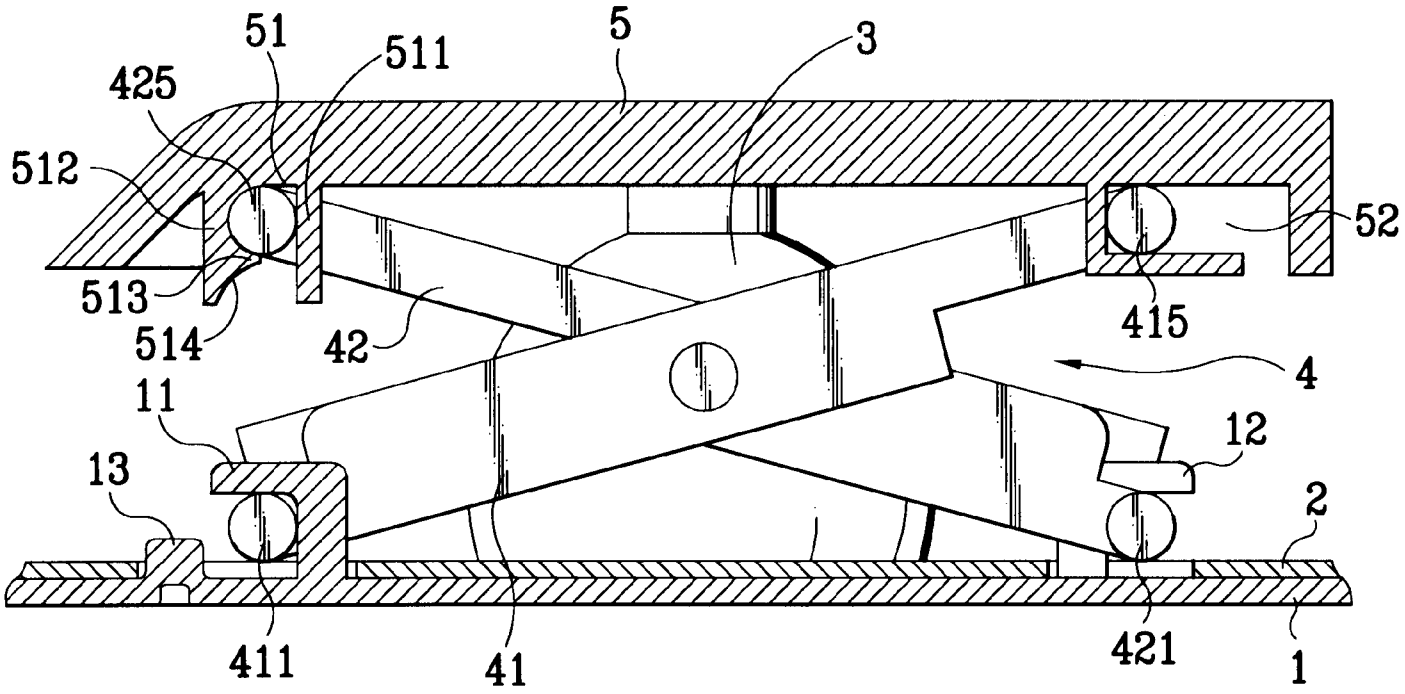
FIG. 2 is the cross-section view of the inventive keyswitch.

As shown in FIGS. 1 and 2, a pivot groove 52 is provided on the key 5 for the pivotal connection of the first support lever 41, wherein the pivot shaft 415 of the first support lever 41 is slidable within the groove 52. A pivot recess 51 is formed on the key 5 and corresponding to the second support lever 42. The pivot recess 51 is formed by two adjacent retaining walls 511 and 512, the separation therebetween enables the two walls to clamp the second pivot shaft 425. One of the wall 512 has a hook 513 formed on the free end thereof. The hook 513 sustains at least half-length portion of the second pivot shaft 425 of the support lever 42. A bevel 514 is formed on the exterior portion of the hook 513 by which the second pivot shaft 425 is easier to engage into the pivot recess 51. The other wall 511 has thinner thickness than the wall 512 and therefore is more flexible.

Figure 3:
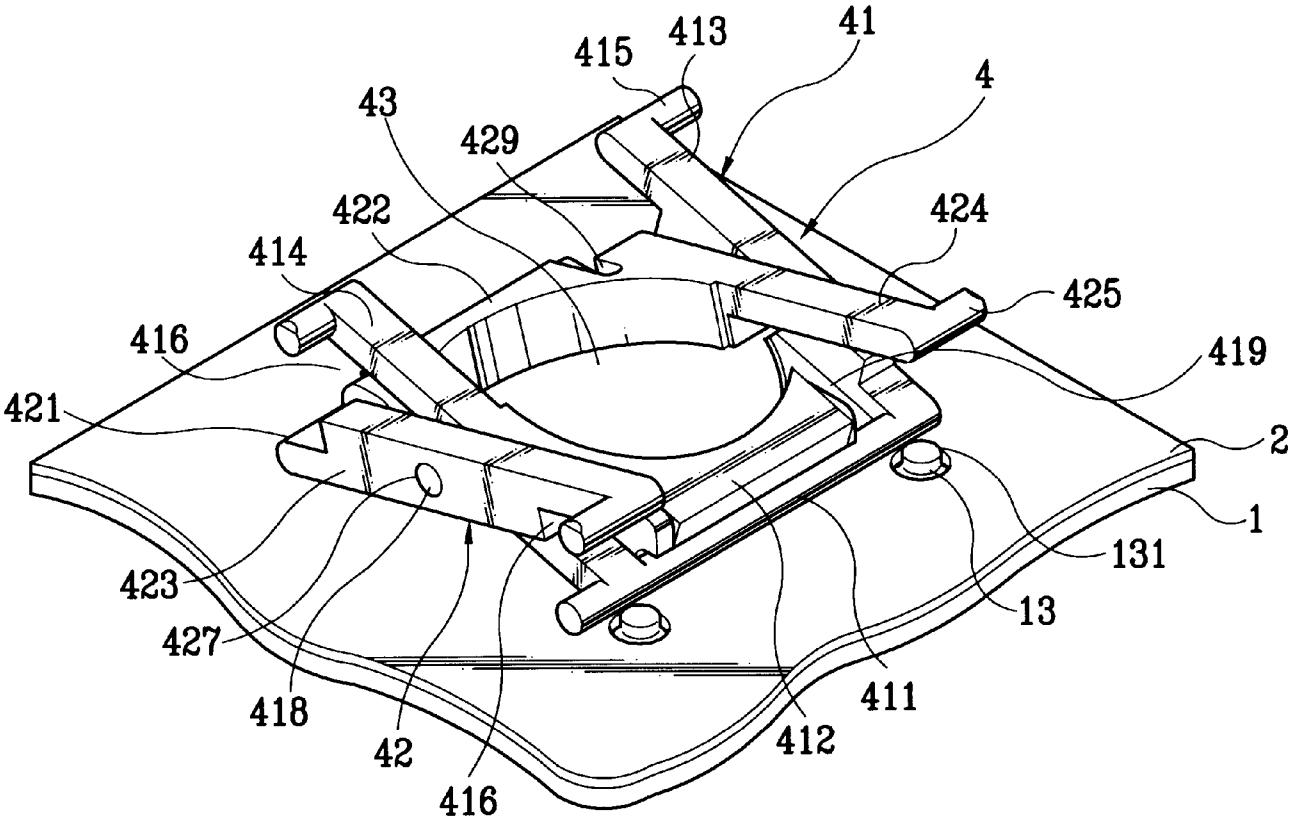
FIG. 3 is the perspective view of the inventive keyswitch.
Figure 4:
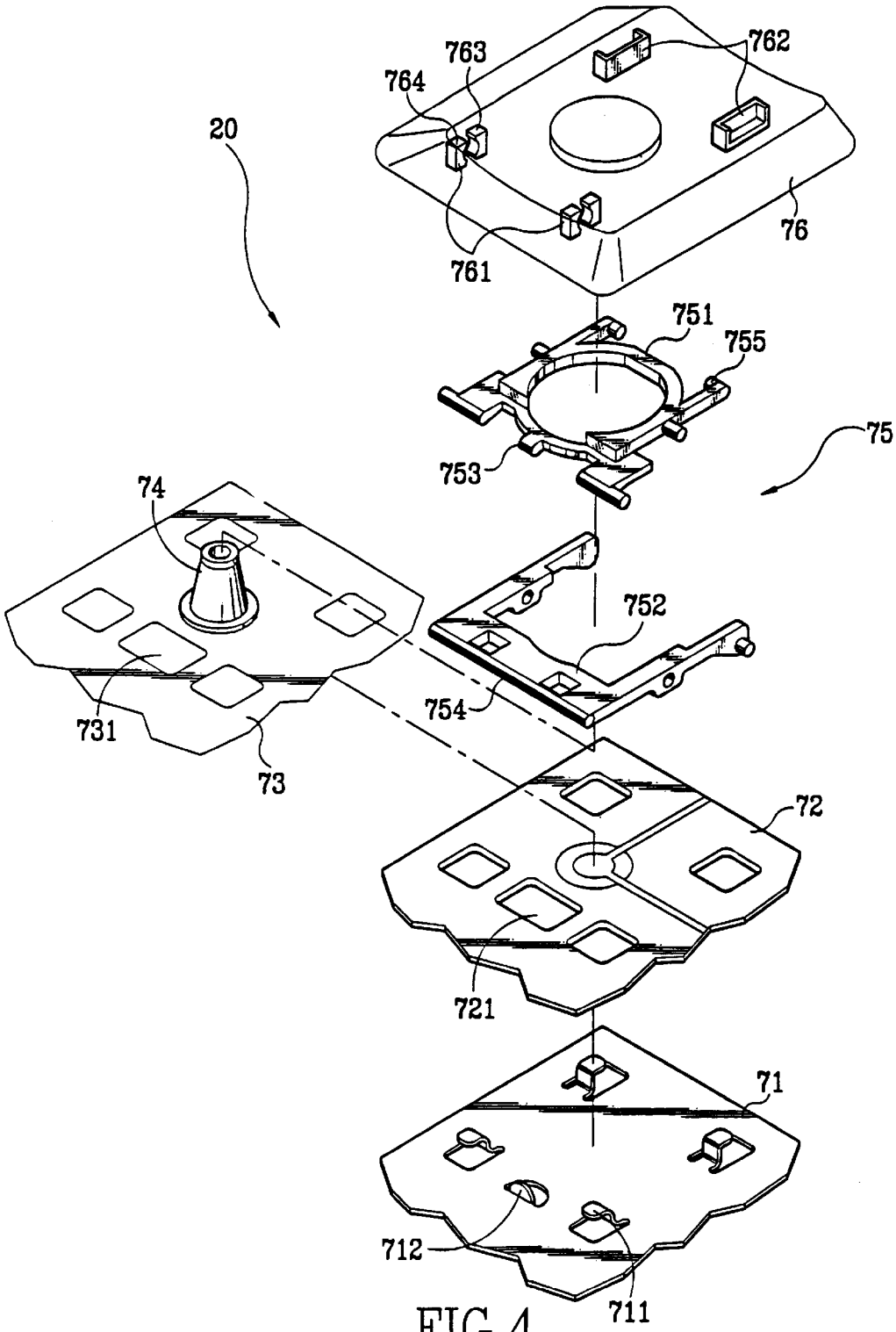
FIG.4 PRIOR ART
FIG. 4 is the exploded view of a conventional keyswitch.
Figure 5:
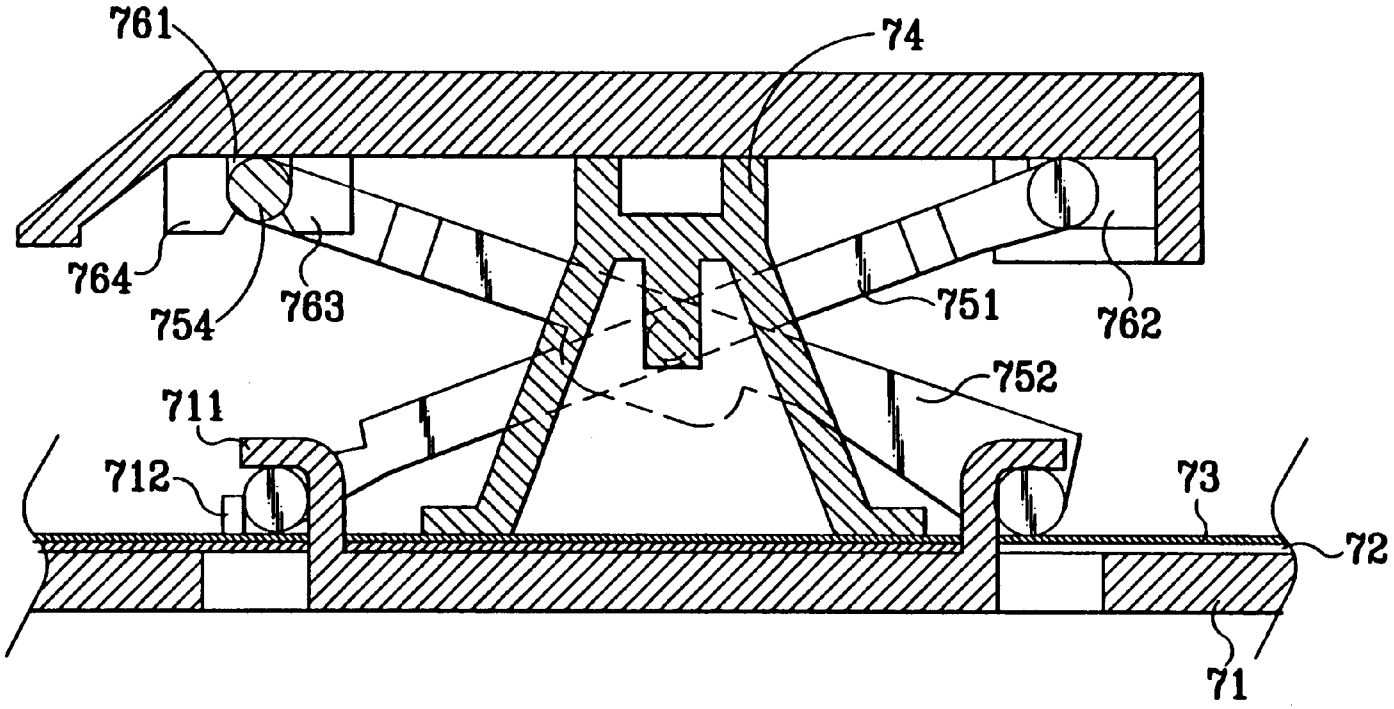
FIG.5 PRIOR ART
FIG. 5 is the cross-section view of a conventional keyswitch.

As shown in FIG. 3, two pivot grooves 11 and 12 are arranged on the base plate and corresponding to the two support levers 41 and 42, and have L shape. When assembling, the L-shaped pivot grooves 11 and 12 first are passed through the opened grooves 419 and 429 of the support levers 41 and 42 and then drawn back such that the first lateral shaft 411 and second lateral shaft 421 are engaged within the grooves 11 and 12. Two stop poles 13 are arranged on the base plate 1 and beside the groove 11. The two stop poles 13 are separated by a predetermined distance and have chamfered side 131. Moreover, the base plate 1 has no opening formed between the two stop poles 13, the through holes 21 on the conductive membrane 2 and corresponding to the stop poles 13 is not necessary to be large.

With reference again to FIG. 1, when the key support mechanism 4 is to be assembled within the keyswitch 10, the two support levers 41 and 42 are arranged in a scissors-form and have the same orientation. At this time, the first and second vertical shafts 413, 414 and the third and vertical shafts 423, 424 of the two support levers 41 and 42 are arranged in cross fashion such that the through holes 417, 427 and the projecting bar 418, 428 of the vertical shafts 413, 414 and 423, 424 are pivotally connected to each other. The pivot shafts 415 and 425 of the vertical shaft 413, 414 and 423, 424 of the two support levers 41 and 42 are pivotally engaged within the pivot recess 51, 52 of the cap 5, and the hook 513 of the pivot recess 51 clamps the pivot shaft 425, as shown in FIG. 2. Moreover, when the two support levers 41 and 42 are in horizontal state, the lateral shaft 411 (421) of the support lever 41 (42) is just engaged within the dent 426 (416) formed in another support lever 42 (41). Afterward, the two support levers 41 and 42 are pivotably arranged on the base plate 1. The pivot grooves 12 are first passed the opened groove 429 of the support lever 42 such that the lateral shaft 421 of the support lever 42 is engaged into the pivot groove 12. Afterward, the pivot groove 11 is passed through the opened groove 419 of the support lever 41 such that the lateral shaft 11 of the support lever 41 is engaged within the pivot groove 11 of the base plate. The assembling of whole key support mechanism 4 is thus completed.

In the present invention, the support levers 41 and 42 are assembled by arranging between the key the base plate 1 in cross fashion and with same orientation because they are of same structure. The assembling task is more convenient. Moreover, the hook 513 of the pivot recess 51 on the cap 5 has length exceeding half length of the second pivot shaft 425. The wall 511 is thinner and has flexibility such that the wall 511 can be pull outward without the problem of breaking during extraction. Moreover, two stop poles 13 are arranged beside the pivot groove 11 to retain the first lateral shaft 411 of the support lever 41 within the pivot groove 11, when the first lateral shaft 411 is arranged on the base plate 1. Therefore, the support lever 41 will not shake laterally. The edge of the stop pole 13 is provided with chamfered portion 131 to facilitate the pivotal engagement of the support lever 41 into the pivot recess 11.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

We claim:

1. A key switch comprising:

a base plate member having a lower pivot groove formed therein;

a conductive membrane fixedly mounted on said base plate member;

an elastic member;

a key having an upper pivot groove and a pivot recess formed therein;

a key support mechanism having first and second support levers, said first and second support levers being centrally pivotally mounted each to the other and having identical U-shaped structural contours, said first support lever forming first and second vertical shafts and having a first pivot shaft slidably mounted within said upper pivot groove of said key and having a first lateral shaft pivotally mounted within said lower pivot groove of said base plate member, said second support lever forming a third and a fourth vertical shaft and having a second pivot shaft pivotally secured within said pivot recess of said key, said pivot recess containing at least one-half of the length of said second pivot shaft, said pivot recess forming first and second walls, said first and second walls being contiguous with said second pivot shaft, said first wall having a hook formed thereon, said hook having a length greater than a radius of said second pivot shaft, said second wall having a thickness less than that of said first wall to allow for structural flexibility, said second support lever having a second lateral shaft in slidable electrical contact with said conductive member.

2. The key switch as recited in claim 1 wherein said first and second pivot shafts lie in a separate plane from said first and second lateral shafts.

3. The key switch as recited in claim 2 wherein said first and second support levers have respective dents formed within said first and second vertical shafts, adjacent said first and second pivot shafts.

4. The key switch as recited in claim 2 wherein said first and third vertical shafts each have a projecting bar formed at the center thereof and extending therefrom, and said second and fourth vertical shafts each having a through hole formed at the center thereof for mating with the corresponding said projecting bar.

5. A key switch comprising:

a base plate member having a lower pivot groove formed therein;

a conductive membrane fixedly mounted on said base plate member;

an elastic member;

a key having an upper pivot groove and a pivot recess formed therein;

a key support mechanism having first and second support levers, said first and second levers being centrally pivotally mounted each to the other and having identical U-shaped structural contours, said first support lever forming first and second vertical shafts and having a first pivot shaft slidably mounted within said upper pivot groove of said key and having a first lateral shaft pivotally mounted within said lower pivot groove of said base plate member, said second support lever forming a third and a fourth vertical shaft and having a second pivot shaft pivotally secured within said pivot recess of said key, said pivot recess containing at least one-half of the length of said second pivot shaft, said pivot recess forming first and second walls, said second support lever having a second lateral shaft in slidable electrical contact with said conductive member, said first and second pivot shafts lie in a separate plane from said first and second lateral shafts, said first and second lateral shafts each having a semi-circular shaped rib formed thereon, said semi-circular shaped ribs together forming a circular groove for clamping said elastic member.

6. The key switch as recited in claim 5 wherein said pivot recess comprises first and second walls, said first and second walls contiguous with said second pivot shaft, said first wall having a hook formed thereon, said hook having a length greater than the radius of said second pivot shaft, said second wall having a thickness less than that of said first wall to allow for structural flexibility.

7. The key switch as recited in claim 6 wherein a bevel is formed on an outer side of said hook.

8. The key switch as recited in claim 5 wherein first and second stop poles are formed on said base plate, said stop poles positioned to retain said first lateral shaft within said lower pivot groove, said first and second stop poles having chamfered edges.

* * * * *